US005957419A

United States Patent [19]

Lancaster et al.

[11] Patent Number: 5,957,419

[45] **Date of Patent: *Sep. 28, 1999**

[54] ADJUSTABLE SUPPORT APPARATUS FOR BOAT SEATS

[75] Inventors: Arthur W. Lancaster, St. Ann, Mo.; William A. Benson, Belleville, Ill.

[73] Assignee: B & B Marine Manufacturing, Inc., St. Ann, Mo.

[ * ] Notice: This patent issued on a continued prosecution application filed under 37 CFR 1.53(d), and is subject to the twenty year patent term provisions of 35 U.S.C. 154(a)(2).

[21] Appl. No.: 08/612,267

[22] Filed: Mar. 7, 1996

[51] Int. Cl.[6] ..... F16M 11/20; F16M 11/26; F16M 11/38; A47F 5/00

[52] U.S. Cl. ..... 248/188.1; 248/188.5; 248/188.6; 248/354.5

[58] Field of Search ..... 248/188.1, 188.5, 248/188.6, 354.5

[56] References Cited

U.S. PATENT DOCUMENTS

| | | | |
|---|---|---|---|
| 1,552,104 | 9/1925 | Zahner | 248/188.5 |
| 2,735,702 | 2/1956 | Larson | 248/188.6 |
| 2,963,257 | 12/1960 | Ferguson | 248/354.5 |
| 2,969,108 | 1/1961 | MacKnight | 248/188.1 |
| 3,269,574 | 8/1966 | Bennett | 248/354.5 |
| 3,303,936 | 2/1967 | Barnawell | 248/188.1 |
| 3,963,272 | 6/1976 | Jones | 248/188.6 |
| 4,148,524 | 4/1979 | Guyton | 248/188.5 |
| 4,222,559 | 9/1980 | Hammer | 248/188.5 |
| 4,923,156 | 5/1990 | Linnéusson | 248/188.6 |
| 4,966,341 | 10/1990 | Borsani | 248/188.5 |
| 5,108,065 | 4/1992 | Puerner | 248/188.1 |
| 5,331,905 | 7/1994 | Hammers et al. | 248/188.1 |

OTHER PUBLICATIONS 1,552,104; Sep. 1925, Zahner, 248/188.5.
3,963,272; Jun. 1976, Jones, 248/188.6.

*Primary Examiner*—Tamara L. Graysay
*Assistant Examiner*—Matthew A. Kaness
*Attorney, Agent, or Firm*—Greenfelder, Hemker & Gale, P.C.

[57] ABSTRACT

The apparatus is a framework comprised of a base stand member, support legs and a brace member. The apparatus rests on the support legs on the bottom surface of the boat with the brace member engaging a rigid portion of the boat. The base stand member provides mounting support for an auxiliary boat seat.

18 Claims, 6 Drawing Sheets

ADJUSTABLE SUPPORT APPARATUS FOR BOAT SEATS

BACKGROUND OF THE INVENTION

This invention relates to supports for auxiliary boat seats of the type which can be installed or mounted in small boats, such as bass boats, john boats, aluminum V-bottom boats and the like.

Boating and fishing from a boat are activities enjoyed by a great number of people. Whether fishing or just floating along, the boater typically spends a considerable amount of time sitting upright in the boat. Larger boats are usually provided with comfortable seats, many of which may be padded and can swivel to increase the enjoyment of the boater. Most small boats, however, are modest in design and are not constructed to accommodate those that have back troubles, or those that wish to experience maximum comfort. Typically, these types of boats come with only flat seats that merely comprise bare platforms with no back support. After a while, sitting upright in these boats can get quite uncomfortable.

To counter this problem, there are available auxiliary seats for mounting and installation in boats which can provide not only a more comfortable place to sit but can also provide support for the user's back. However, these auxiliary seats can be difficult to install because of the lack of suitable mounts on the boat through which to drill. Many mounts are adapted to be placed on the floor of the boat, which requires drilling through the bottom of the boat. This creates an obviously hazardous situation and a potentially leaky boat. Other seat kits mount directly on the existing boat seat platform. While many of these seat kits allow for swivel movement, the full benefit of that feature is lost because the boat seat, which spans the width of the boat, hinders the user's legs from freely swinging 360°.

Therefore, there exists the need for a mount and support for an auxiliary seat for installation on small boat craft that can provide the comfort of a true bass boat type seat. There further exists the need for such a mount which can impart full swivel functionality to the auxiliary boat seat.

SUMMARY OF THE INVENTION

It is a feature of this invention, therefore, to provide a support for mounting an auxiliary seat in a boat. The invention contemplates adaptation and use with such auxiliary seats, which are quite common and generally comprise a standard seat form integrated with a mount plate or other means from which depends a mounting shaft. The support apparatus of the instant invention comprises a base stand member for receiving the mounting shaft of the boat seat, support legs which engage the bottom of the boat, and a brace arm for attachment to the edge of the front seat of the boat or other appropriate mounting point.

The components can be constructed in such a manner to allow for easy assembly and disassembly, and can be marketed as a kit packaged with all the elements broken down. The various elements are comprised of tubular metal which are pre-drilled to accommodate the connecting hardware and allow for height and length adjustment.

The base stand member is comprised of two support legs which are somewhat L-shaped and are joined together by bolting through the aligned holes so that the lower feet extensions are directed outward. A receptacle tube for receiving the boat seat shaft is positioned between the two legs. It also has holes which correspond to the alignment of holes along the support legs. This allows for vertical adjustment to vary the height of the supported seat as the user wishes.

The brace arm is connected to the joined leg structure by a bracket for structural sturdiness. The brace arm provides for attachment to the front seat structure of the boat to give stability to the erected seat assembly. The combined seat assembly of the instant invention therefore provides for three point stability when installed.

The boat seat support of the instant invention provides a safe, sturdy mounting support for an auxiliary seat for use in small boats. The simple construction permits easy assemblage and installation, and breaks down after use for easy transport and storage.

It is therefore an object of this invention to provide a seat support framework for mounting auxiliary seats in small boats.

It is further an object of this invention to provide such a seat support framework that is sturdy yet of simple construction which is readily assembled and dissembled.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

DESCRIPTION OF THE INVENTION

Figure 1:
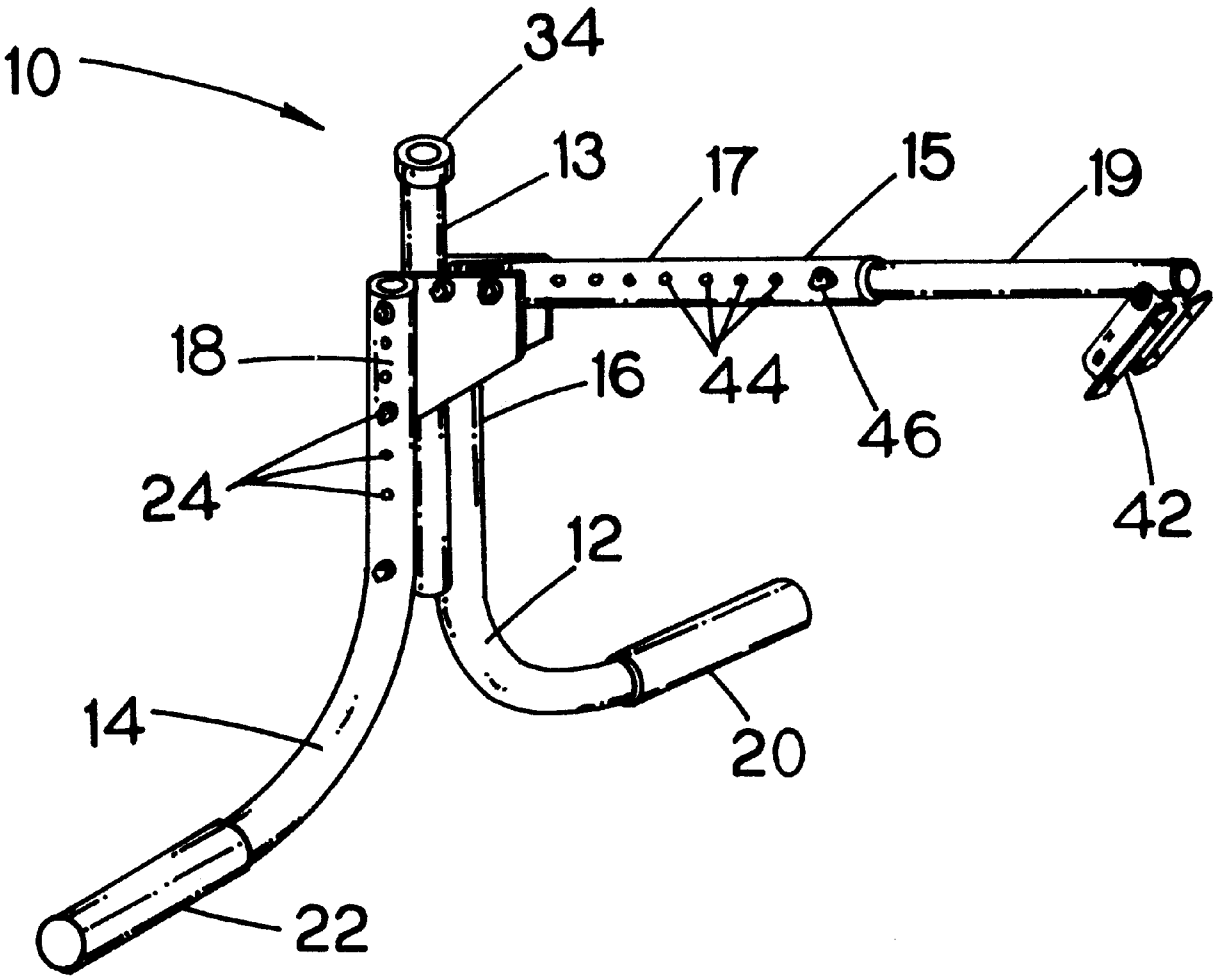
FIG. 1 is a perspective view of the assembled support framework.
Figure 2:
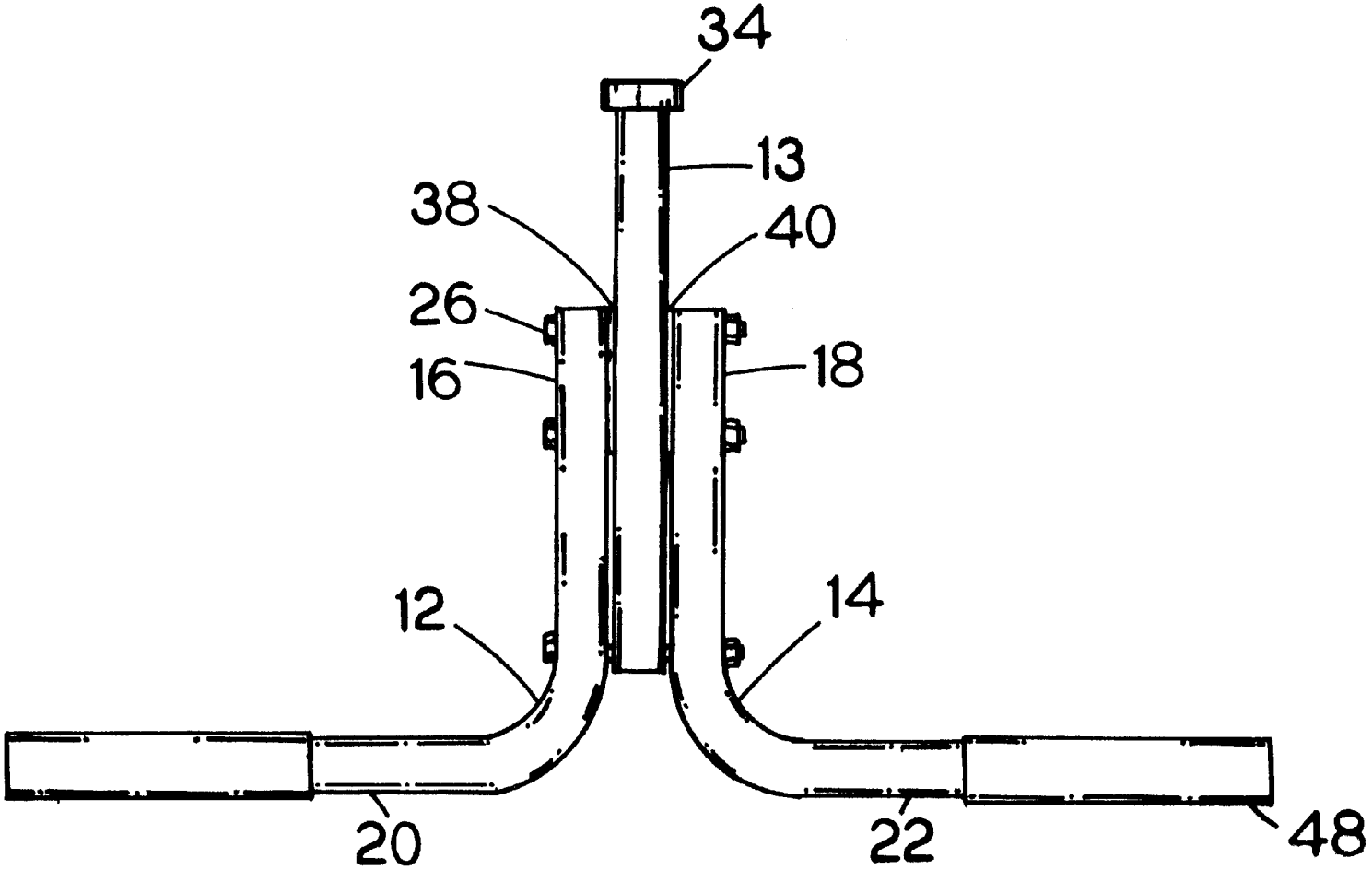
FIG. 2 is a view in side elevation taken from the rear of the support framework.

The seat framework of the instant invention is generally indicated by the reference numeral 10 as shown in FIG. 1. It is comprised of a pair of leg supports 12 and 14, a shaft member 13, and brace member 15. Leg supports 12 and 14 are formed with elongated upper portions 16 and 18, and elongated lower portions 20 and 22, respectively. The framework is best constructed of aluminum tubing for strength and light weight. Other suitable materials include thin wall steel tubing, galvanized tubing, polyvinyl chloride and other similar plastics. The thickness dimensions of the aluminum tubing should be sufficient to withstand the load weight which can be expected from users of all sizes and stature. For instance, 1" to 1½" tube or bar stock would be appropriate. A series of diametrical aperture holes 24 are disposed along and are in registry alignment with each of upper portions 18 and 16 of the leg supports. A plurality of bolts 26, which pass through holes 24, are provided for connecting the leg supports to each other such that lower portions 20 and 22 of the leg supports face away from each other and serve as foot extensions as shown in FIG. 2.

Figure 4:
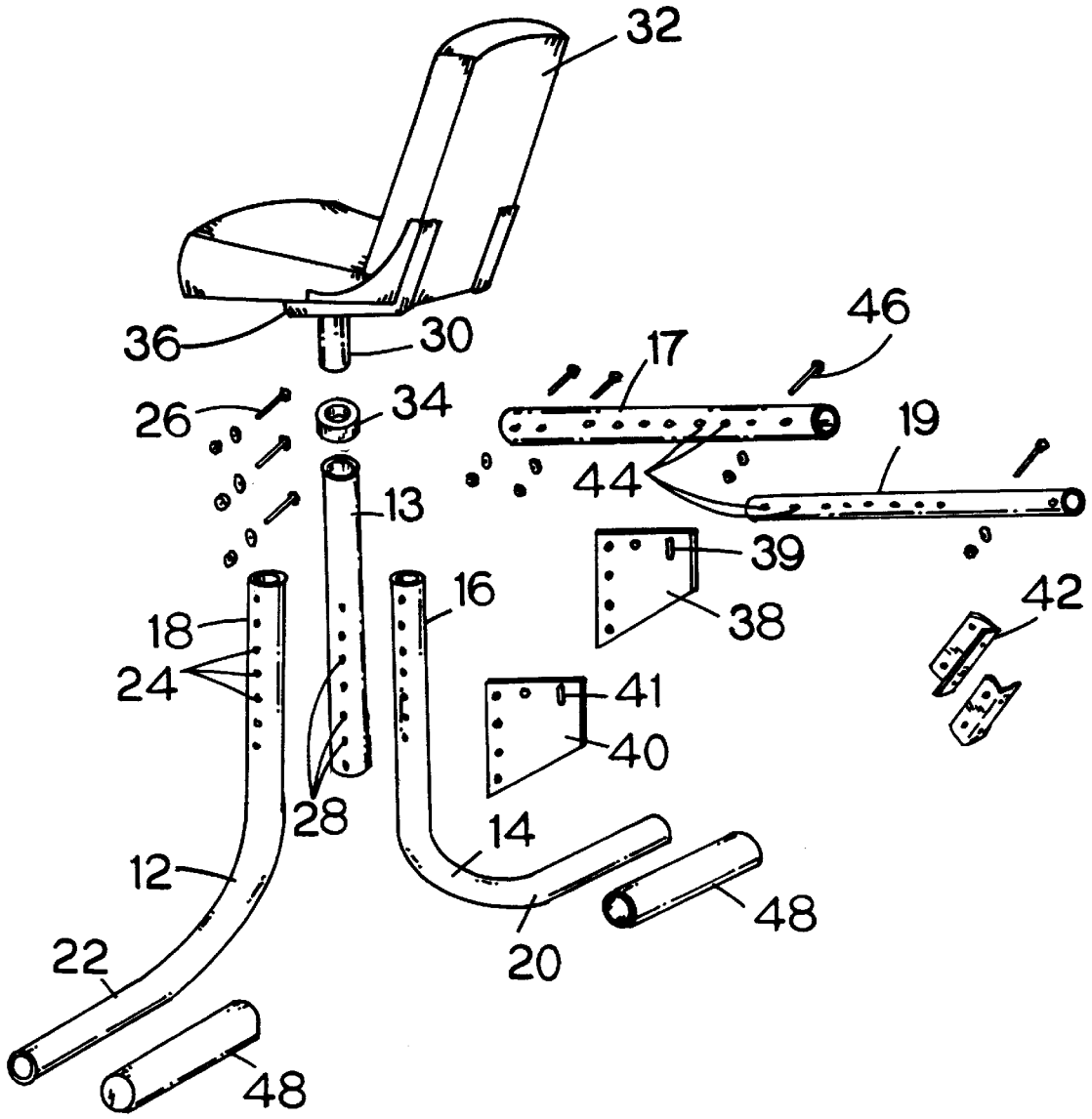
FIG. 4 is an exploded view of the elements of the support framework.
Figure 5:
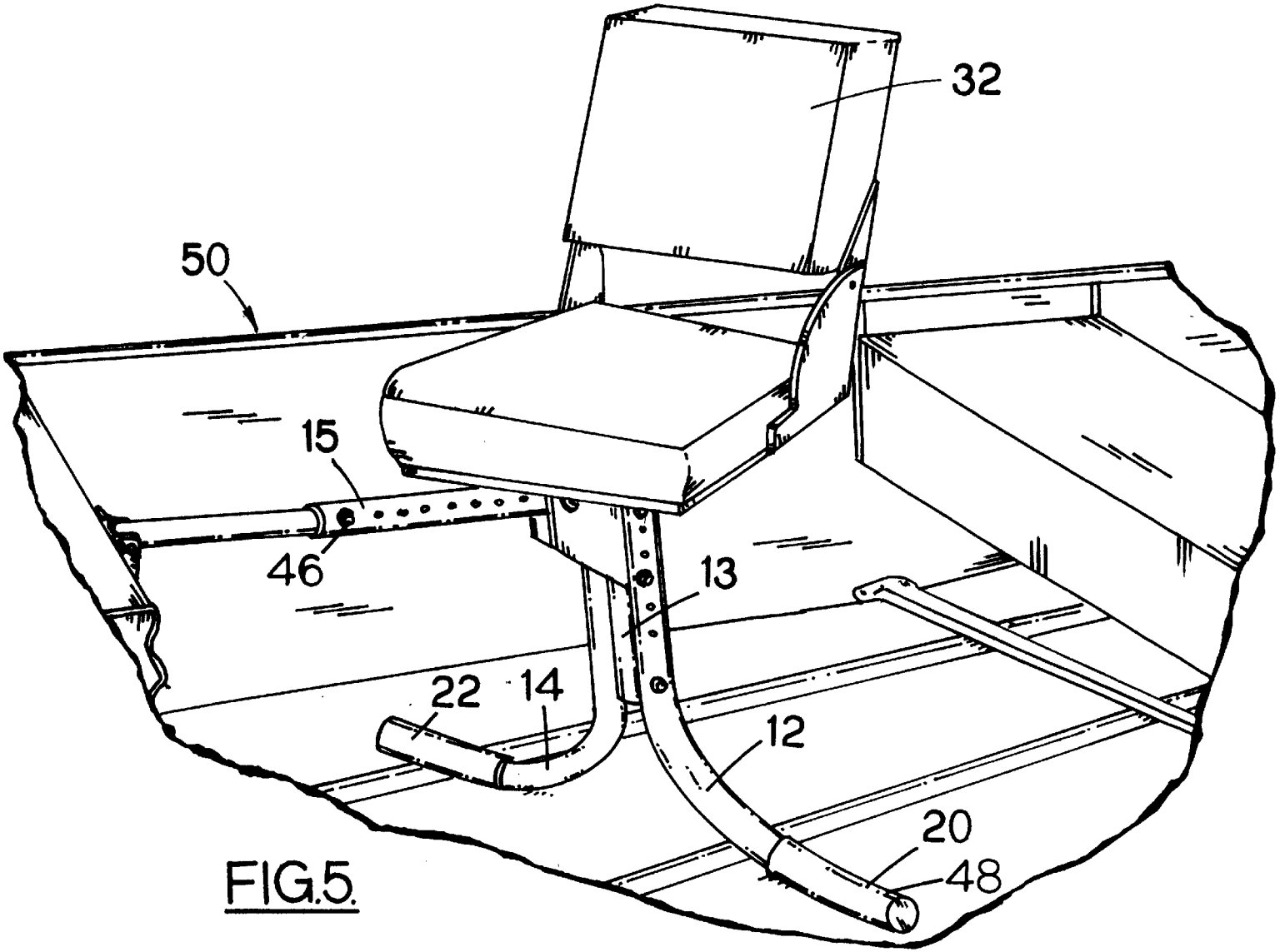
FIG. 5 is a perspective view of the support framework in place on a boat and supporting a seat.

Shaft member 13 also has holes 28 placed diametrically which receive the bolts 26 so that shaft member 13 is held in position between the leg supports. The shaft is hollow so that it can receive the mounting shaft 30 of an auxiliary seat member 32 as shown in FIGS. 4 and 5. A bearing ring 34 upon which seat plate 36 rests and swivels when installed is positioned on top of shaft member 13.

Figure 3:
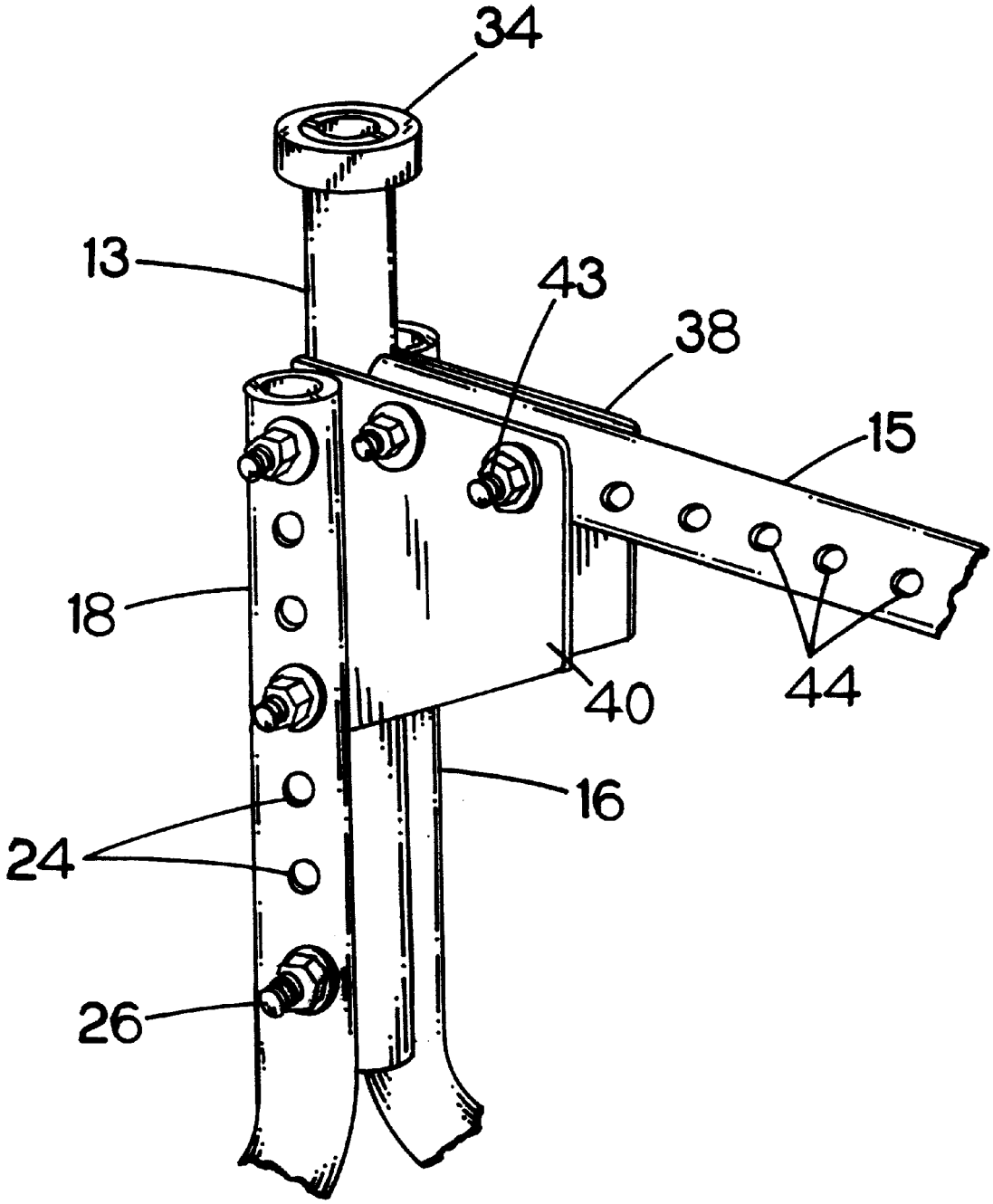
FIG. 3 is a perspective view focussing on the points of connection of the elements of the support framework.

Bracket plates 38 and 40 connect on to leg supports 12 and 14, respectively, as shown in FIG. 3, and receive an end of brace member 15. The bracket plates have appropriately spaced holes for receiving bolts for connection to the leg supports and brace member 15. Brace member 15 is an elongated shaft which allows for connecting seat frame 10 in a spaced apart relationship to the boat framework. Bracket plates 42 are provided at the end of brace member 15 for connection with the boat framework. Brace member 15 may be comprised of telescoping members 17 and 19 to provide means for varying the distance between the seat frame and the point of attachment on the boat. Each of the telescoping members are provided with a series of holes 44 which can move into registry alignment to receive a bolt 46 for varying the length of brace member 15. The brace may be subject to substantial stress during use, so it may be necessary to provide reinforcement to it to prevent collapsing. For instance, bushings or reinforcing cylinders can be fitted onto telescopic members 17 and 19 at points of increased stress.

The seat framework 10 can alternately be comprised of an integral piece. For instance, a single tube can serve as the upper portion, and the leg elements and the brace member can be welded thereto substantially in the manner shown in the drawings.

USE

The support apparatus of the instant invention provides a useful means for installing an auxiliary seat member into a boat. Such an arrangement enhances the versatility of the auxiliary seat in that a stable, adjustable swivel seat, with minimal need for direct bolting onto the boat, is created which provides a significant improvement and advantage over the auxiliary seat member mounting means itself. The seat framework can be readily assembled and disassembled and installed for use, and can be marketed as a kit with all the separate components ready for assemblage by the user.

The main framework as seen in FIG. 2 is assembled by aligning leg supports 12 and 14 back to back with foot extensions 20 and 22 facing outwardly. The foot extensions are splayed out to give support and stability to the framework when installed for use. For greater stability, it is desirable that leg portions 20 and 22 together span a substantial distance along the width of the boat. If the apparatus is used in a V-bottomed boat, the foot extensions can be bent to accommodate and lie along the particular pitch. Protective coverings 48 can be placed over the foot extensions to prevent slippage. Such coverings can be a rubber sheath, friction tape wrap, or other suitable material. Shaft receiving member 13 is positioned between and connected to the upper portions 16 and 18 of the leg supports. Holes 24 of the leg supports and holes 28 of shaft receiving member 13 are aligned so as to allow bolts 26 to pass through. The plurality of holes allows member 13 to be raised or lowered to adjust the height at which the auxiliary seat rests when mounted. Member 13 is simply moved in vertical relationship with respect to the leg supports to bring holes 28 into registry with holes 24 and re-bolted. An adequate number of bolts should be employed between leg supports 12 and 14 to provide sufficient stability to the apparatus when member 13 is raised to elevated levels.

Brace member 15 is connected to the main framework by brackets 38 and 40 as seen in FIG. 3. These brackets have a side edge and a top edge each provided with a plurality of holes for alignment with holes 24 of the leg supports and holes 44 of brace member 15. Because the framework is expected to withstand a substantial weight load, at least two bolts are used at each of the side and top edges for stability and to prevent accidental collapsing. Holes 39 and 41 are slightly elongated to form an oval shape. This allows bolt 43 to be moved within holes 39 and 41 for pivotal adjustment of the base stand with respect to the brace member, within 15° or so, so that a vertical positioning of the seat can be adjusted and maintained. Not all boats are constructed alike, so the pitch of a particular boat bottom may cause the seat stand to lean unless this pivot adjustment is provided. Brace member 15 can be lengthened by extending telescopic members 17 and 19 and re-aligning holes 44 for bolt connection.

Figure 6:
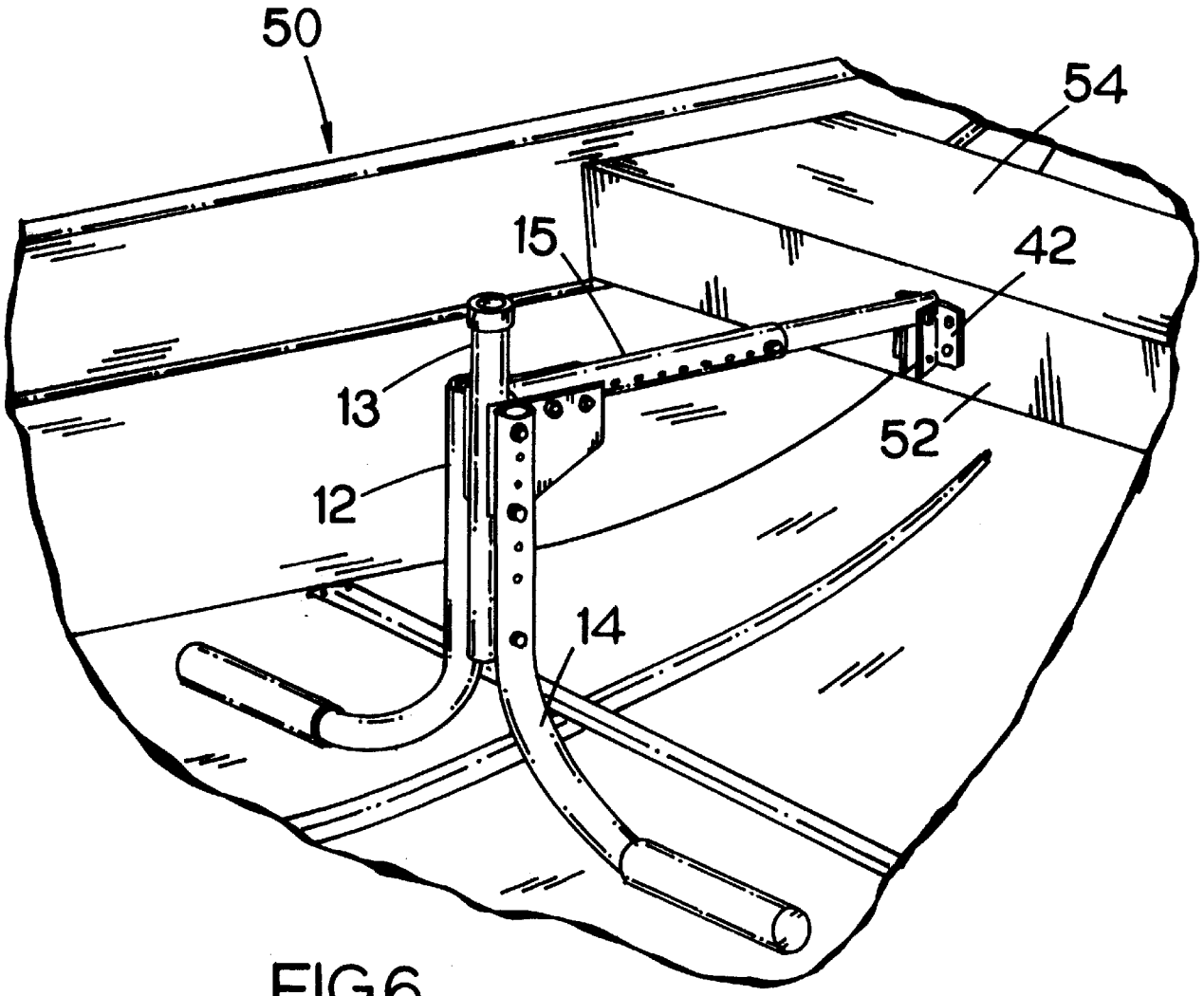
FIG. 6 is another perspective view of the support framework in place on a boat.

After the main framework is set up as shown in FIG. 1, it can easily be installed in a boat 50 as shown in FIGS. 5 and 6. Brace member 15 has brackets 42 at its forward end which enable the framework to be connected to a rigid surface of the boat, for instance, the side edge 52 of the front seat shelf 54 as shown in FIG. 6. The brackets must first be mounted in place on the boat surface, here the seat edge 52 as shown in FIG. 6. This point of connection is the only place that the seat framework is fixedly connected to the boat. However, a substantial stability is maintained because the framework is supported on the splayed out foot extensions. Thus, there is minimal intrusion into the structure of the boat, whereas other prior art devices require a substantial amount of drilling to affix a mounting base for the auxiliary seat. While the seat edge 52 is the preferred point of attachment, other points of attachment, such as the side wall of the boat or other suitable surface, may alternately be used. A clamping arrangement, much like that used to secure a trolling motor onto the edge of the boat, can also be used.

FIG. 5 shows an auxiliary boat seat mounted on the seat framework. Through this arrangement, a user can sit in the boat having complete swivel capability over a 360° range. This provides a definite advantage over the flat, backless seat provided in the boat. Further, the single point of attachment arrangement leaves the actual boat seat surfaces free to accommodate other passengers.

While the invention as heretofore described contemplates discrete parts to provide a ready to assemble/disassemble framework, it can also be constructed such that all the connections are fixed by welding or the like to provide an integrated structure.

Various changes and modifications may be made within this invention as will be apparent to those skilled in the art. Such changes and modifications are within the scope and teaching of this invention as defined in the claims appended hereto.

What is claimed is:

1. A support apparatus for receiving and supporting a shaft of a seat member for use in boats, said support apparatus comprising:

a base stand member, leg members, and an elongated brace member, said leg members being connected to said base stand member, said brace member being transversely connected to said base stand member, said leg members being positioned to support said base stand member in vertical relationship to said legs, said brace member adapted to support said base stand member in spaced relationship from a separate framework surface, said base stand member having a receptacle adapted to supportably receive said shaft of said seat member, whereby said brace member is adapted to engage a rigid framework surface of a boat and said leg members engage a bottom interior surface of said boat to support said base stand member and said seat member within said boat.

2. The support apparatus of claim 1 in which means are provided for varying the height at which said seat member is supported.

3. The support apparatus of claim 1 in which a length of said brace member is adjustable whereby a distance between said base stand member and said rigid surface of said boat can be varied.

4. The support apparatus of claim 1 in which means are provided for varying the height at which said seat member is supported, and a length of said brace member is adjustable whereby a distance between said base stand member and said rigid surface of said boat can be varied.

5. The support apparatus of claim 1 in which each of said leg members are configured such that a substantial portion thereof lies in a horizontal plane whereby said leg members substantially engage said bottom surface of said boat in a stable and balanced relationship.

6. The support apparatus of claim 5 in which means are provided on said leg members to prevent slippage along said bottom surface.

7. The support apparatus of claim 1 in which said receptacle of said base stand member is adapted to receive said shaft of said seat member in swivel relationship.

8. The support apparatus of claim 1 in which said base stand member and said lea members are comprised respectively of a support shaft member and a pair of bent support members, each support member having elongated upper and lower portions, said upper portions of said support members and said support shaft member having means for being connected adjacently together, said lower portions of said support members being bent a sufficient degree from said upper portions so that a substantial length of each of said lower portions is engageable with said bottom surface of said boat.

9. The support apparatus of claim 8 in which said means for adjacently connecting includes a plurality of transversely disposed apertures provided along each of said upper portions of said support members and said support shaft member to enable connection therebetween by a fastener when said apertures are aligned, whereby said support shaft member is adjustable in vertical relationship with said support members by varying an alignment between said apertures of said support shaft member with respect to said apertures of said support members for connection, whereby the height at which said seat member is supported is adjustable.

10. The support apparatus of claim 1 in which said brace member has means for connecting said base stand member to said rigid surface of said boat, said brace member being comprised of first and second telescoping members, each of said first and second telescoping members having a plurality of transversely disposed apertures to enable connection therebetween by a fastener when said apertures are aligned, said telescoping members being adjustable in linear relationship with each other by varying an alignment between said apertures, whereby a length of said brace member is adjustable.

11. A kit for building a support framework to receive an auxiliary boat seat member of the type comprising a seat member and mounting means, said kit comprising:

a base stand member, leg members, and an elongated brace member, said leg members being connected to said base stand member, said brace member being transversely connected to said base stand member, said leg members being positioned to support said base stand member in vertical relationship to said legs, said brace member adapted to support said base stand member in spaced relationship from a separate framework surface, said base stand member having a receptacle adapted to supportably receive said seat member, whereby said brace member is adapted to engage a rigid framework surface of a boat and said leg members are adapted to engage a bottom interior surface of said boat to support said base stand member and said seat member within said boat, said component elements having means for assembly and disassembly.

12. The kit of claim 11 in which said base stand member and said leg members are comprised respectively of a support shaft member and a pair of bent support members, each support member having elongated upper and lower portions, said upper portions of said support members and said support shaft member having means for being connected together, said support shaft member having means for receiving and supporting said seat member, said lower portions of said support members being bent a sufficient degree from said upper portions so that upon assembly a length of each of said lower portions is engageable with said bottom surface of said boat.

13. The kit of claim 12 in which a plurality of transversely disposed apertures are provided along each of said upper portions of said support members and said support shaft member to enable connection therebetween by a fastener when said apertures are aligned, whereby upon assembly said support shaft member is adjustable in vertical relationship with said support members by varying an alignment between said apertures of said support shaft member with respect to said apertures of said support members, whereby the height at which said seat member is supported is adjustable.

14. The kit of claim 13 in which said brace member has means for connecting said base stand member to said rigid surface of said boat, said brace member being comprised of first and second telescoping members, each of said first and second telescoping members having a plurality of transversely disposed apertures to enable connection therebetween by a fastener when said apertures are aligned, said telescoping members being adjustable in linear relationship with each other by varying an alignment between said apertures, whereby upon assembly a length of said brace member is adjustable.

15. The kit of claim 14 in which said brace member is connected to said base stand member by at least one bracket plate member, said bracket plate member having a planar surface, said planar surface having a sufficient dimension to simultaneously engage portions of said brace member and at least one of said support members in transverse relationship, said bracket plate member having a plurality of apertures which upon assembly can be brought into alignment with said apertures of said support member and said brace member to provide a means of connection therebetween by a fastener.

16. A combination seat member and support apparatus for use in a boat comprising:

a seat member, a base stand member, leg members, and an elongated brace member, said leg members being connected to said base stand member, said brace member being transversely connected to said base stand member, said leg members being positioned to support said base stand member in vertical relationship to said legs, said brace member adapted to support said base stand member in spaced relationship from a separate framework surface, said base stand member having a receptacle adapted to supportably receive said seat member, whereby said brace member is adapted to engage a rigid framework surface of a boat and said leg members are adapted to engage a bottom interior surface of said boat to support said base stand member and said seat member within said boat.

17. The support apparatus of claim 16 in which means are provided for varying the height at which said seat member is supported.

18. The support apparatus of claim 17 in which a length of said brace member is adjustable whereby a distance between said base stand member and said rigid surface of said boat can be varied.

* * * * *

UNITED STATES PATENT AND TRADEMARK OFFICE

CERTIFICATE OF CORRECTION

PATENT NO : 5,957,419

DATED : September 28, 1999

INVENTOR(S) : Lancaster, Arthur W., et al.

It is certified that error appears in the above-identified patent and that said Letters Patent is hereby corrected as shown below:

Claim 8, line 2, after "said", change "lea" to --leg--;

Claim 18, line 1, change "claim 17" to --claim 16--.

Signed and Sealed this

Eighteenth Day of April, 2000

*Attest:*

Q. TODD DICKINSON

*Attesting Officer*

*Director of Patents and Trademarks*